US005107593A

United States Patent [19]

Hutchins

[11] Patent Number: 5,107,593

[45] Date of Patent: Apr. 28, 1992

[54] SCRAPER BLADE AND METHOD OF MAKING SAME

[75] Inventor: Walter J. Hutchins, W. Hartford, Conn.

[73] Assignee: The Stanley Works, New Britain, Conn.

[21] Appl. No.: 710,378

[22] Filed: Jun. 3, 1991

[51] Int. Cl.[5] ..... B26B 9/00

[52] U.S. Cl. ..... 30/346; 30/169; 30/337; 30/356; 76/104.1

[58] Field of Search ..... 30/169-172, 30/329, 337-339, 356, 346; 15/236.01; 76/101.1, 104.1

[56] References Cited

U.S. PATENT DOCUMENTS 1,068,731 7/1913 Blum .
1,091,370 3/1914 Menke .
1,195,297 8/1916 Vlchek .
1,241,307 9/1917 Tompkins .
1,693,566 11/1928 Pflueger .
1,767,948 6/1930 Taylor .
2,195,720 4/1940 Davenport ..... 30/356 X
2,201,911 5/1940 Mizera .
2,646,581 7/1953 Nelson .
2,646,621 7/1953 Catanese .
2,674,794 4/1954 Baker .
2,797,294 6/1957 Cox .
3,688,401 9/1972 Hartman .

*Primary Examiner*—Douglas D. Watts
*Attorney, Agent, or Firm*—Chilton, Alix & Van Kirk

[57] ABSTRACT

A blank for a scraper blade is disclosed. The blade is designed to fit into a utility knife and is bent so as to be useful as a scraper.

35 Claims, 2 Drawing Sheets

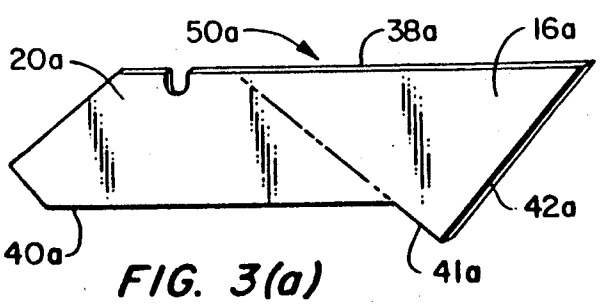
FIG. 3(a)
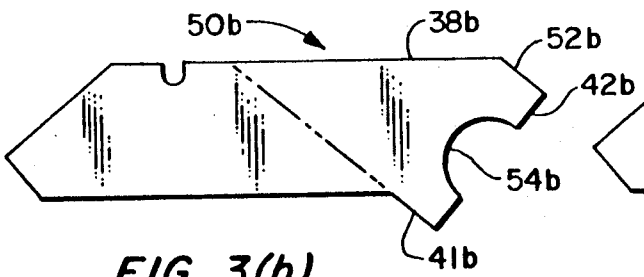
FIG. 3(b)
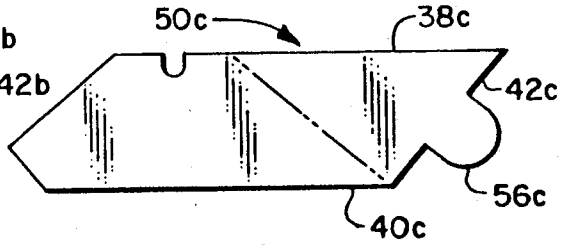
FIG. 3(c)
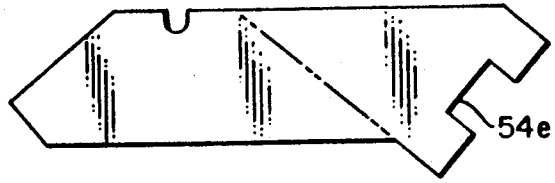
FIG. 3(d)
FIG. 3(e)
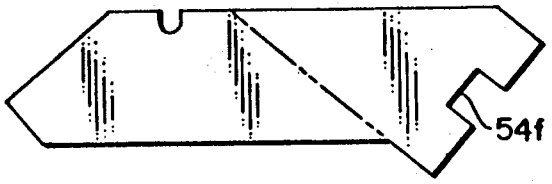
FIG. 3(f)
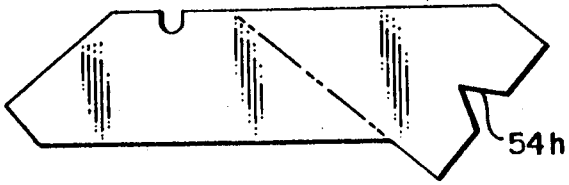
FIG. 3(g)
FIG. 3(h)
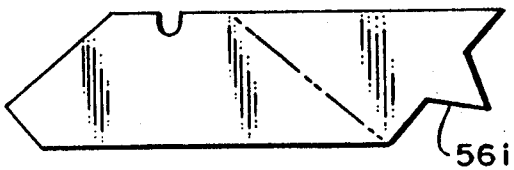
FIG. 3(i)

SCRAPER BLADE AND METHOD OF MAKING SAME

BACKGROUND OF THE INVENTION

The present invention generally relates to blades and more particularly relates to blades for scraping.

Scraping tools which are useful for the removal of paint, putty and the like typically include a scraper blade mounted to the end of a handle. Many conventional handles have a scraper blade permanently mounted thereon, while other handles are adapted to hold detachable scraper blades. In both cases, the scraping tools which are known in the art have handles which are specifically designed for use with scraper blades, as contrasted to cutting blades.

SUMMARY OF THE INVENTION

An object of the invention is to provide a novel blade blank which can be formed into a scraper blade.

Another object of the invention is to provide a scraper blade which can be mounted on the handle of a conventional utility knife.

Yet another object of the invention is to provide a scraper blade which can be detachably mounted on a handle.

Another object of the invention is to provide a scraper blade which does not require sharpening.

A further object of the invention is to provide a scraper blade which is relatively easy to manufacture, requiring only stamping and bending operations.

Another object of the invention is to provide a tool which can be used interchangeably as a utility knife and a scraping tool by changing the blade.

Other objects will be in part obvious and in part pointed out more in detail hereinafter.

Briefly stated, the present invention in a preferred form is a blank for a scraper blade suitable for mounting on a utility knife handle. The blank includes an elongated strip having a substantially planar mounting portion at one end and an integral working portion at the opposite end. The working portion includes a terminal scraping edge. The working portion and scraping edge are suited for displacement out of the plane of the mounting portion along a bend line which has an axis extending at an angle oblique to the longitudinal dimension of the strip. When the elongated strip is bent, the scraping edge is placed in a working position angularly offset from the plane of the mounting portion. The scraping edge preferably is straight, and can have one or more notches or projections formed thereon. The scraping edge preferably is perpendicular to the bend line.

Another embodiment of the invention in its preferred form is a scraper blade suitable for mounting on a utility knife handle. The scraper blade preferably is formed by stamping a blade blank from a metal sheet, and then bending the blade blank. Depending upon the desired strength of the blade, it may be useful to heat treat the bent blade. The scraper blade includes an elongated strip having a substantially planar mounting portion at one end and an integral working portion at the opposite end. The working portion includes a terminal scraping edge. The working portion and scraping edge are angularly offset from the plane of the mounting portion along a bend line which has an axis extending at an angle oblique to the longitudinal dimension of the strip.

Preferably, the working portion, including the scraping edge, is perpendicular to the mounting portion.

The invention accordingly consists in the features of construction, combination of elements and arrangement of parts which will be exemplified in the construction hereafter set forth and the scope of the application which will be indicated in the appended claims.

BRIEF DESCRIPTION OF THE DRAWINGS

In the drawings:

FIG, 1 is a perspective view, partly broken away, of a utility knife incorporating the scraper blade of the invention.

FIG. 3(*a*) is a perspective view of the blade blank used to form the scraper blade shown in FIG. 2.

FIGS. 3(*b*)–3(*i*) are front views of various preferred embodiments of blade blanks according to the invention.

DETAILED DESCRIPTION OF THE INVENTION

Figure 1:
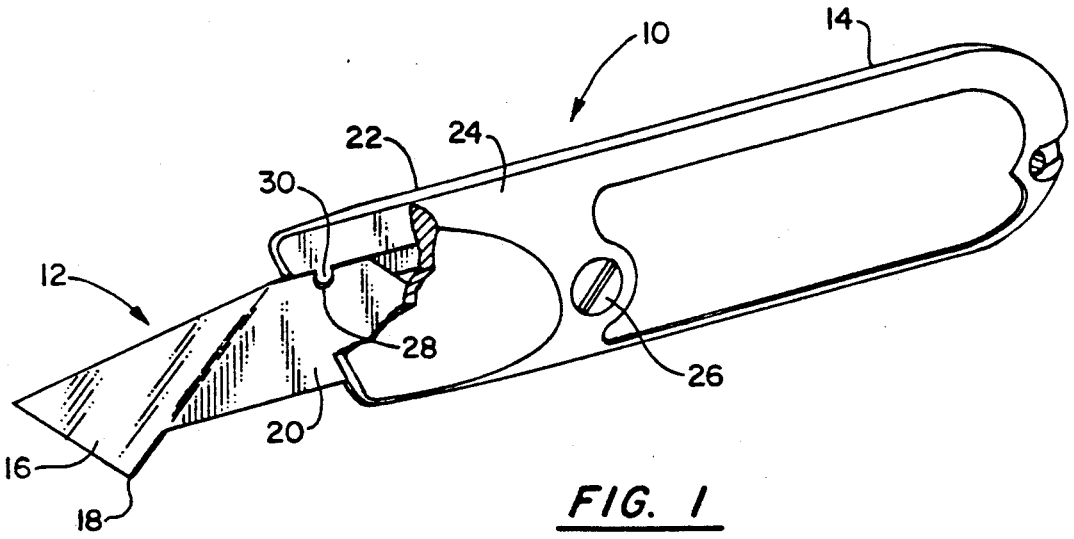

With reference to the drawings wherein like numerals represent like parts throughout, and referring now to FIG. 1, a scraping tool 10 is shown, which includes a scraper blade 12, and a conventional utility knife handle 14 which is adapted to interchangeably support a cutting blade and a scraper blade. The scraper blade 12, the structural details of which will be described below with reference to FIG. 2, has a planar working portion 16 having a terminal scraping edge 18 adapted to contact a surface to be scraped, and a planar mounting portion 20 which is perpendicular to the working portion 16 and is partially disposed within the handle 14. The handle 14 includes first and second handle halves 22,24, respectively, connected by a fastener 26. The first and second handle halves 22,24 sandwich the rear part of the mounting portion 20, holding it in place when the screw 26 is tightened. Similar to a conventional cutting blade for a utility knife, the mounting portion 20 of the scraper blade 12 has a mounting notch 28 which is placed around a projection 30 on the inside of the first handle half 22 in order to properly position and firmly retain the scraper blade 12 relative to the handle 14.

As shown in FIG. 1, the working portion 16 of the blade 12 preferably is positioned relative to the handle 14 such that when the scraping tool 10 is used, the working portion 16 forms an angle of about 40°–50° with the surface to be scraped. However, the angle of the working portion relative to the surface to be scraped can be any angle which enables the user to effectively scrape the surface. Preferably, the scraping edge 18 is perpendicular to the general scraping direction. However, the scraping edge also may be oblique relative to the direction of the scraping motion.

Figure 2:
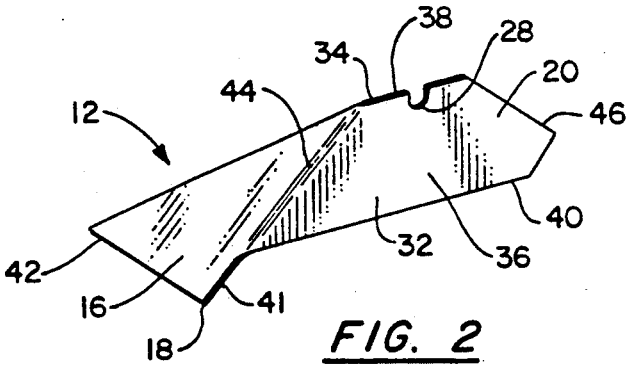
FIG. 2 is a perspective view of the scraper blade used in the utility knife shown in FIG. 1.

FIG. 2 separately shows the scraper blade which is incorporated into the scraping tool 10 shown in FIG. 1. The scraper blade 12 comprises a bent, carbon steel strip 32 having a uniform thickness of about 1 mm. The strip 32 can be made of any material which results in an effective scraper blade, and its thickness can be selected to suit its intended use. The strip 32 has opposite front and back faces 34,36 respectively, which are connected to each other by a narrow upper surface 38, and a narrow lower surface 40. The upper surface 38 and the lower surface 40 each extend along both the working portion 16 and the mounting portion 20 of the blade.

The narrow lower surface 40 includes a lower surface extension 41 proximate the scraping edge 18, which lies in a different plane than the remainder of the lower surface 40, and extends in a direction away from the upper surface 38. The lower surface extension 41 ensures that the entire scraping edge 18 is able to contact the surface to be scraped, by providing space between the end of the scraping edge and the adjacent corner of the mounting portion, which lies in a different plane. The working portion 16 of the scraper blade 12 includes a narrow scraping surface 42, which connects with the upper surface 38 at one end and the lower surface extension 41 at the opposite end. The front face 34 and scraping surface 42 mate to form the scraping edge 18.

As shown in FIG. 2, the strip 32 is bent at a right angle along a bend line 44 which extends obliquely from the upper surface 38 to the lower surface 40. The strip can be bent at an angle other than a right angle, or can be curved instead of bent, to result in any angle or curve which will place the scraping edge in a working position. The bend line 44 delineates the working portion 16 and the mounting portion 20. Preferably, the bend line 44 connects with an end of the lower edge extension 41, and has an axis which is perpendicular to the scraping edge 18. However, the angle between the bend line and scraping edge can be any angle which results in an effective scraping edge. The bent blade 12 is preferably, but not necessarily, heat treated.

The mounting portion 20 of the scraper blade 12 includes a narrow, L-shaped back surface 46 which is similar in shape to the back surface of a conventional cutting blade for a utility knife. The shape of the back surface 46 can be varied in any form which will allow it to be mounted to a handle which is suitable for a scraper.

In the preferred scraper blade 12 shown in FIG. 2, the working portion 16 is shaped as a right triangle, the right angle being formed by the intersection of the scraping surface 42 and the lower surface 40. The angle between the bend line and the upper surface 38 of the working portion 16 is preferably about 40°, but, as mentioned above, any angle which places the scraping edge in a working position can be used.

When the scraper blade 42 shown in FIG. 2 is viewed in a direction from the mounting portion 20 to the working portion 16, the bend line 44 is on the left side of the blade. Alternatively, the blade can be folded such that the bend line 44 is on the right side of the blade.

As shown in FIG. 2, the mounting notch 28 is formed on the upper surface 38 of the strip 32. This notch can be moved to any location on the mounting portion which corresponds to a complementary projection 30 on the handle 14, or can be substituted by any other positioning means which will hold the blade 12 in place. The blade 12 can have several mounting notches 28 on the same or on different surfaces thereof.

One of the important features of the invention is that the blade 12 does not need to be sharpened. The scraping edge 18, formed by the connection of the scraping surface 42 and the front face 34 at a right angle, is sufficiently sharp for many scraping operations. However, it also is within the scope of the invention to sharpen the blade in any workable manner. For example, the scraping surface 42 can be so narrow that it is essentially identical to the scraping edge 18. Furthermore, the scraping surface 42 can be angled relative to the front face 34 or back face 36 in any fashion which will result in an effective scraping edge. The scrape blade 12 is a particularly effective scraping tool when the surface to be scraped is heated.

FIG. 3(*a*) shows a blade blank 50*a* from which the blade 12 of FIG. 2 is formed. The blade blank 50*a* is flat and can be stamped from a metal sheet. The bend line 44*a*, which is not visible on the blade blank 50*a*, has been illustrated in phantom in FIG. 3. Bend line 44*a* delineates the working portion 16*a* and mounting portion 20*a*.

As described above with respect to the blade 12 shown in FIG. 2, the lower surface 40*a* of the blade blank 50*a* shown in FIG. 3 includes a lower surface extension 41*a*, which extends away from the upper surface 38*a* proximate the scraping surface 42*a*. The lower surface extension 41*a* forms a right angle with the scraping surface 42*a*. It is noted that the lower surface extension 41*a* can extend at any angle relative to the remainder of the lower surface 40*a* and relative to the scraping surface 42*a* which will result in a functional scraper blade. The scraping surface 42*a* shown in FIG. 3 is substantially straight, without any notches or projections formed thereon.

FIGS. 3(*b*)–3(*i*) illustrate other preferred embodiments of blade blanks according to the present invention. The embodiment illustrated in FIG. 3(*b*) is similar to the embodiment of FIG. 3(*a*), except that the portion of the upper surface 38*b* of blade blank 50*b* which is proximate the scraping surface 42*b* bends toward the lower surface 40*b* while remaining within the plane of the flat strip 32*b*, thereby providing an upper surface extension 52*b*. As shown, the upper surface extension 52*b* forms a right angle with the scraping surface 42*b*, and is parallel to the lower surface extension 41*b*. The scraping surface 42*b* is substantially straight, but has a semicircular notch 42*b* centrally located along its length for scraping a curved molding, for example. According to the invention, the upper and lower surface extensions 41*b*, 52*b* each can extend at any angle relative to the upper and lower surfaces of the blade which will result in an effective scraper blade. When both upper and lower surface extensions are present, as shown in the embodiment shown in FIG. 3(*b*), they do not necessarily have to be parallel.

The embodiments of FIGS. 3(*d*)–(*f*) and 3(*h*) are similar to that of FIG. 3(*b*), except for differences in the notch. In FIG. 3(*d*) the centrally located semicircular notch 54*d* is smaller than the notch 54*b* in FIG. 3(*b*). In FIG. 3(*e*) the centrally located notch 54*e* is rectangular. In FIG. 3(*f*) the centrally located notch 54*f* is rectangular, and is smaller than notch 54*e*. In FIG. 3(*h*) the centrally located notch 54*h* is triangular.

The embodiment of FIG. 3(*c*) has neither an upper surface extension nor a lower surface extension. The scraping surface 42*c* of the blade blank 50*c* connects with the straight upper surface 38*c* and the straight lower surface 40*c*. The scraping surface 42*c* is substantially straight, but has a semi-oval projection 56*c* centrally located thereon. FIGS. 3(*g*) and 3(*i*) illustrate embodiments which are similar to that shown in FIG. 3(*c*) except that in FIG. 3(*g*) the projection 56*g* is rectangular, and in FIG. 3(*i*) the projection 56*i* is triangular. It is noted that the scraping surface of the blade according to the invention can have notches and/or projections along any portion of its length, including its entire length. The notches and projections can have any suitable shape.

As will be apparent to persons skilled in the art, various modifications and adaptations of the structure above described will become readily apparent without departure from the spirit and scope of the invention.

What is claimed is:

1. A blank for a scraper blade suitable for mounting on a utility knife handle, comprising an elongated strip having a substantially planar mounting portion at one end and an integral working portion at the end opposite the one end, the working portion including a terminal scraping edge, the working portion and scraping edge being suited for lateral displacement in one lateral direction out of the plane of the mounting portion along a bend line having an axis extending at an angle oblique to the longitudinal dimension of the strip to place the scraping edge in a working position angularly offset from the plane of the mounting portion entirely on one lateral side of the mounting portion.

2. A blank according to claim 1, wherein the working portion has a pair of parallel, opposite front and back faces and a narrow end surface connecting the front and back faces, the scraping edge being defined by the junction of the end surface and at least one of the front and back faces.

3. A blank according to claim 1, wherein the scraping edge has a notch formed thereon.

4. A blank according to claim 1, wherein the scraping edge has a projection formed thereon.

5. A blank according to claim 1, wherein the mounting portion includes mounting means.

6. A blank according to claim 5, wherein the mounting means defines a mounting notch.

7. A blank according to claim 2, wherein the mounting portion has a narrow first side surface connecting the front and back faces, the narrow side surface being connected to the end surface.

8. A blank according to claim 7, wherein the mounting portion has a narrow second side surface connecting the front and back faces, the narrow second side surface being connected to the end surface.

9. A blank according to claim 7, wherein, proximate the end surface, the narrow first side surface is perpendicular to the end surface.

10. A blank according to claim 8, wherein, proximate the end surface, the narrow first and second side surfaces are perpendicular to the end surface.

11. A scraper blade suitable for mounting on a utility knife handle comprising an elongated strip having a substantially planar mounting portion at one end and an integral working portion at the end opposite the one end, the working portion including a terminal scraping edge, the working portion and scraping edge being laterally displaced in one lateral direction out of the plane of the mounting portion along a bend line having an axis extending at an angle oblique to the longitudinal dimension of the strip, the scraping edge being disposed in a working position angularly offset from the plane of the mounting portion entirely on one lateral side of the mounting portion.

12. A scraper blade according to claim 11, wherein the working portion has a pair of parallel, opposite front and back faces and a narrow end surface connecting the front and back faces, the scraping edge being defined by the junction of the end surface and at least one of the front and back faces.

13. A scraper blade according to claim 11, wherein the scraping edge has a notch formed thereon.

14. A scraper blade according to claim 11, wherein the scraping edge has a projection formed thereon.

15. A scraper blade according to claim 11, wherein the mounting portion includes mounting means.

16. A scraper blade according to claim 13, wherein the mounting portion has a narrow first side surface connecting the front and back faces, the narrow side surface being connected to the end surface.

17. A scraper blade according to claim 16, wherein the mounting portion has a narrow second side surface connecting the front and back faces, the narrow second side surface being connected to the end surface.

18. A scraper blade according to claim 16, wherein, proximate the end surface, the narrow first side surface is perpendicular to the end surface.

19. A scraper blade according to claim 17, wherein, proximate the end surface, the narrow first and second side surfaces are perpendicular to the end surface.

20. A scraper blade according to claim 12, wherein the scraping edge is substantially perpendicular to the mounting portion.

21. A scraper blade according to claim 12, wherein the working portion is substantially perpendicular to the mounting portion.

22. A method of making a scraper blade comprising the steps of:

forming a blade blank comprising an elongated strip having a substantially planar mounting portion at one end and an integral working portion at the end opposite the one end, the working portion including a terminal scraping edge, the working portion and scraping edge being suited for lateral displacement in one lateral direction out of the plane of the mounting portion along a bend line having an axis extending at an angle oblique to the longitudinal dimension of the strip, and bending the elongated strip along the bend line to place the scraping edge in a working position, angularly offset from the plane of the mounting portion entirely on one lateral side of the mounting portion.

23. A method according to claim 22, further comprising the step of heat treating the bent strip.

24. A blank according to claim 1, wherein the blank is adapted for forming a blade that is detachable mountable on a handle.

25. A scraper blade according to claim 11, wherein the scraper blade is detachably mountable on a handle.

26. A scraper blade according to claim 11, wherein the working portion is substantially planar.

27. A scraper blade according to claim 26, wherein the working portion is generally perpendicular to the mounting portion.

28. A blank for a scraper blade suitable for mounting on a utility knife handle, comprising an elongated strip having a substantially planar mounting portion at one end and an integral working portion at the end opposite the one end, the working portion including a terminal scraping edge, the working portion and scraping edge being suited for displacement out of the plane of the mounting portion along a bend line having an axis extending at an angle oblique to the longitudinal dimension of the strip and generally perpendicular to the scraping edge to place the scraping edge in a working position angularly offset from the plane of the mounting portion.

29. A blank according to claim 28, wherein the scraping edge has a notch formed thereon.

30. A blank according to claim 28, wherein the scraping edge has a projection formed thereon.

31. A blank according to claim 28, wherein the mounting portion includes a mounting notch.

32. A scraper blade suitable for mounting on a utility knife handle comprising an elongated strip having a substantially planar mounting portion at one end and an integral working portion at the end opposite the one end, the working portion including a terminal scraping edge, the working portion and scraping edge being displaced out of the plane of the mounting portion along a bend line having an axis extending at an angle oblique to the longitudinal dimension of the strip and generally perpendicular to the scraping edge, the scraping edge being disposed in a working portion angularly offset from the plane of the mounting portion.

33. A scraper blade according to claim 32, wherein the scraping edge has a notch formed thereon.

34. A scraper blade according to claim 32, wherein the scraping edge has a projection formed thereon.

35. A scraper blade according to claim 32, wherein the mounting portion includes a mounting notch.

* * * * *

UNITED STATES PATENT AND TRADEMARK OFFICE

CERTIFICATE OF CORRECTION

PATENT NO. : 5,107,593

DATED : April 28, 1992

INVENTOR(S) : Walter J. Hutchins

It is certified that error appears in the above-identified patent and that said Letters Patent is hereby corrected as shown below:

Column 6

Claim 24, line 2, change "detachable" to -- detachably --.

Signed and Sealed this

First Day of February, 1994

*Attest:*

*Attesting Officer*

BRUCE LEHMAN

*Commissioner of Patents and Trademarks*